US010847942B2

(12) United States Patent
Grünberger

(10) Patent No.: US 10,847,942 B2
(45) Date of Patent: Nov. 24, 2020

(54) ELECTRIC ADAPTER

(71) Applicant: Andro Grünberger, Hutthurm (DE)

(72) Inventor: Andro Grünberger, Hutthurm (DE)

( * ) Notice: Subject to any disclaimer, the term of this patent is extended or adjusted under 35 U.S.C. 154(b) by 0 days.

(21) Appl. No.: 16/479,045

(22) PCT Filed: Feb. 5, 2018

(86) PCT No.: PCT/DE2018/100091
§ 371 (c)(1),
(2) Date: Jul. 18, 2019

(87) PCT Pub. No.: WO2018/145695
PCT Pub. Date: Aug. 16, 2018

(65) Prior Publication Data

US 2019/0372285 A1 Dec. 5, 2019

(30) Foreign Application Priority Data

Feb. 8, 2017 (DE) ..... 10 2017 102 513

(51) Int. Cl.
*H01R 31/06* (2006.01)
*H01R 27/00* (2006.01)

(52) U.S. Cl.
CPC ..... *H01R 31/065* (2013.01); *H01R 27/00* (2013.01)

(58) Field of Classification Search
CPC ..... H01R 13/46; H01R 13/66; H01R 31/00; H01R 31/06; H01R 27/00
See application file for complete search history.

(56) References Cited

U.S. PATENT DOCUMENTS 2,850,711 A * 9/1958 Terlinde ..... H01R 13/193 439/269.2
5,145,393 A * 9/1992 Schoon ..... H01R 13/20 439/148
7,175,463 B2 * 2/2007 Burton ..... H01R 4/489 439/346
7,303,416 B1 * 12/2007 Liao ..... H01R 13/633 439/173
7,440,287 B1 * 10/2008 Ni ..... H01R 27/00 174/50.51
7,614,892 B2 * 11/2009 Klant ..... H01R 31/06 439/172
9,231,332 B2 * 1/2016 Chai ..... H01R 13/514
(Continued)

FOREIGN PATENT DOCUMENTS

CN 204304160 4/2015
CN 204441656 7/2015
(Continued)

*Primary Examiner* — Oscar C Jimenez
(74) *Attorney, Agent, or Firm* — Themis Law

(57) ABSTRACT

An electric adapter for electrically connecting electric devices to a socket includes a housing portion with at least two contact openings for connecting to a plug of an electric device and a contact device with at least one pair of contact elements for electrically connecting the adapter to a socket. Each of the contact elements is fixed in the housing portion with an anchor portion, and at least one of the contact elements has a mechanically deformable first contact element portion such that the spacing between the second contact element portions, which can be plugged into the socket, can be changed.

20 Claims, 4 Drawing Sheets

(56) References Cited

U.S. PATENT DOCUMENTS

| | | | | |
|---|---|---|---|---|
| 2006/0030189 | A1* | 2/2006 | Hsin | H01R 24/30 439/166 |
| 2009/0061667 | A1* | 3/2009 | Grieff | H01R 31/06 439/151 |
| 2009/0284221 | A1* | 11/2009 | Liao | H01R 31/06 320/111 |
| 2010/0035481 | A1* | 2/2010 | Grieff | H01R 13/639 439/692 |
| 2012/0058677 | A1* | 3/2012 | Choi | H01R 24/30 439/620.21 |
| 2018/0166823 | A1* | 6/2018 | Stockinger | H01R 13/533 |

FOREIGN PATENT DOCUMENTS

| | | |
|---|---|---|
| EP | 2894730 | 7/2015 |
| JP | 2007087897 | 4/2007 |
| WO | 2011146809 | 11/2011 |
| WO | 20130165319 | 11/2013 |

* cited by examiner

ELECTRIC ADAPTER

FIELD OF THE INVENTION

The invention relates to an electric adapter.

BACKGROUND OF THE INVENTION

Electric adapters, in particular so-called travel adapters are known per se. They consist of a male and a female adapter section. The male adapter section has a contact device, which is or can be adapted to match the respective country-specific socket type. The female adapter section has at least two contact openings, which are shaped and spaced apart from each other such that a contact device of a mains power plug, for example, the contact device of the type C mains plug (CEE 7/16), can be connected thereto.

Since the distance between the contact openings of the country-specific sockets can vary, it is necessary for the distance between the contact elements of the contact device formed on the male adapter section to be variable. For example, adapters are known in which the contact device as a whole is interchangeable and thus customizable to the respective outlet socket configuration (e.g. DE 20 2004 017 363 U1). The interchangeability of the entire contact device is both cumbersome and, due to the size of the individual contact device and the necessary plurality of contact devices (one per socket type), also space-consuming.

SUMMARY OF THE INVENTION

Against this background it is the object of the invention to specify an electric adapter which is improved with regard to its usability and its transportability.

The object is achieved by an adapter in accordance with Claim 1. Advantageous embodiments are the subject matter of the dependent claims.

In accordance with one aspect, the invention relates to an electric adapter for electrically connecting electric appliances to a given plug configuration with a country-specific outlet socket. The adapter comprises a housing section, with at least two contact openings for connecting to a (mains) plug of an electric appliance, and a contact device with at least one pair of contact elements for electrically connecting the adapter to an outlet socket. The at least two electric sockets form, for example, the female connector part, the contact device with at least one pair of contact elements forming the male plug part. The contact elements are each held fixedly in the housing section by means of an anchor section. At least one contact element has a mechanically deformable first contact element section, so that the distance between the second contact element sections that can be inserted into the socket can be varied.

The main advantage of the adapter according to the invention is in the fact that by means of the adjustability or configurability of at least one contact element section the distance between the second contact element sections that can be inserted in the outlet socket is variable, and in fact without replacing the entire contact device, but merely by mechanical deformation or adjustment of the contact elements. As a result, the user friendliness and ease of use of the adapter are significantly increased.

In accordance with one exemplary embodiment the first contact element sections of two contact elements forming a contact element pair are designed to be mechanically deformable. This allows both the contact elements, in particular their first contact element sections to contribute to the change in distance between the second contact element sections, which preserves the symmetrical or asymmetrical position of the housing section relative to the contact device and vice versa.

According to one exemplary embodiment, the mechanically deformable first contact element section is arranged between the anchor section and the second contact element section. This allows the parallel or substantially parallel alignment of the second contact element sections to each other to be maintained, so as to obtain an ability to insert the same into the contact openings of the socket.

In accordance with one exemplary embodiment, the mechanically deformable first contact element section has at least two hinged joints. These hinged joints are provided, for example, at a different distance from the anchor section. The pivot axes of the hinged joints can be in particular aligned parallel or substantially parallel to each other. This allows a simple mechanical deformability of the contact elements to be obtained.

In accordance with one exemplary embodiment, the mechanically deformable first contact element section has a spring element which can be deformed by bending. This spring element can in particular be integrally designed. This achieves a mechanical flexibility of the spring element.

In accordance with one exemplary embodiment, the spring element has at least one spring steel strip, or at least one spiral spring. In particular, a pair of spring steel strips, spaced apart either parallel or non-parallel to each other, can be provided per contact element. This allows an easy-to-use contact device, which resets itself back to its initial position, to be obtained.

In accordance with one exemplary embodiment, the mechanically deformable first contact element section has at least one electric conductor, such as an electric cable. This electric conductor can either be used exclusively for connecting (electric connection and mechanical connection) the second contact element section to the housing section, or else the electric cable is provided in addition to a mechanically deformable first contact element section (for example, a strut with hinged joints, spring element, spring steel strip, spiral spring, etc.) for making the electric connection between the electric contacts in the area of the contact openings in the housing section and the contact points formed at the free ends of the second contact element sections.

In accordance with one exemplary embodiment, the mechanically deformable first contact element section has an electric insulation. In particular, the electric insulation is provided on the struts with hinged joints, the spring elements, the spring steel strip, spiral springs, etc. This ensures that the current-carrying sections are electrically isolated externally and can therefore be touched safely.

In accordance with one exemplary embodiment the insulation is formed by a thermoelastic elastomer or a plastic, in particular a VDE-certified plastic. This results in a high insulating effect and a high-endurance insulation.

In accordance with one exemplary embodiment the insulation is formed by encapsulation of at least one part of the contact element. This enables the production cost of the adapter to be reduced.

In accordance with one exemplary embodiment the mechanically deformable first contact element section is designed, after a distance change of the second contact element sections by the action of external forces, to deform back into its starting position automatically when these external forces decrease or are no longer applied. This ensures that the second contact element sections are kept at a desired distance apart in the resting state, for example, a distance of 19 mm or approximately 19 mm.

In accordance with one exemplary embodiment, the mechanically deformable first contact element sections, at least in part, are received in the housing section. Alternatively, they can be located outside the housing. In the event that these are provided inside the housing, there is no risk of touching these current-carrying contact element sections. If they are outside of the housing, they should preferably be provided with an electric insulation, for example by encapsulation with plastic or a similar material.

According to one exemplary embodiment an adjusting mechanism is provided, by means of which the distance between the second contact element sections can be adjusted. This allows the simple adjustment of the contact element sections arranged in the housing.

According to one exemplary embodiment the adjusting mechanism is a lever mechanism, a gear mechanism, or a mechanism comprising at least one eccentric mechanism. A gear mechanism can have, for example, a pair of toothed rods that cooperate with a gear wheel, allowing a linear movement of the contact element sections perpendicular to the insertion direction of the adapter (i.e. the direction in which the adapter is inserted into a socket).

In accordance with one exemplary embodiment, the adjustment of the contact element sections is initiated by a rotation of a part of the housing itself. The adjustment may be performed, in particular, by twisting a housing section about an axis of rotation which extends in, or substantially in, the insertion direction of the adapter. Preferably, an eccentric mechanism is provided, which converts the rotation into a linear motion.

In accordance with one exemplary embodiment, the distance between the second contact element sections can be varied in a range between 10 mm and 30 mm, in particular between 12.7 mm and 26 mm. Starting from a base distance of about, but not necessarily, 19 mm the distance can be both increased as well as decreased by the mechanical deformation of the contact element sections.

In accordance with one exemplary embodiment a USB socket is provided on the housing section. This allows devices, for example mobile devices such as mobile phones, laptops, tablets, E-readers, etc. to be connected to the adapter via USB, for example to charge them.

In accordance with one exemplary embodiment the USB socket can be supplied with electric energy via a self-resetting electric fuse. The electric energy may be provided, in particular, as direct current or DC voltage. The fuse effectively prevents the destruction of the adapter or the connected device by an excessive electric current, and due to the self-resetting property of the fuse no replacement of fuses is necessary. The self-resetting electric fuse may be formed, in particular, by a PTC thermistor or a bi-metal strip.

In accordance with one exemplary embodiment, a storage unit, in particular a flash memory, is provided in the housing section for storing data. This allows data from an electric appliance, for example during its charging process, to be transferred to the adapter and stored in its storage unit, for example, as a backup.

In accordance with one exemplary embodiment, access to the storage unit is via the USB socket. As a result, during the charging operation via the USB socket the backup of data can be accomplished at the same time.

In accordance with one exemplary embodiment the adapter has a network interface, and the storage unit is accessed via a network connection, in particular via a wireless network connection. This allows either wired or wireless access to the data stored on the storage unit and/or the adapter to be externally controlled, e.g. switched on and off.

In accordance with one exemplary embodiment, the storage unit has means for encrypting the data stored, for example, a so-called on-the-fly encryption. This allows the data backup to be protected against unauthorised access.

The terms "approximately", "substantially" or "about" in the context of the invention mean deviations from each exact value by +/−10%, preferably by +/−5% and/or deviations in the form of variations which are insignificant to the functionality.

Extensions, advantages and application possibilities of the invention also arise from the following description of exemplary embodiments and from the drawings. All features described and/or depicted in principle form the subject matter of the invention either alone or in any combination, regardless of how they are drawn up in the claims or by reference thereto. The content of the claims is also considered part of the description.

BRIEF DESCRIPTION OF THE DRAWINGS

Hereafter the invention is explained in more detail by means of exemplary embodiments illustrated in the figures. Shown are.

DETAILED DESCRIPTION OF EMBODIMENTS OF THE INVENTION

Figure 1:
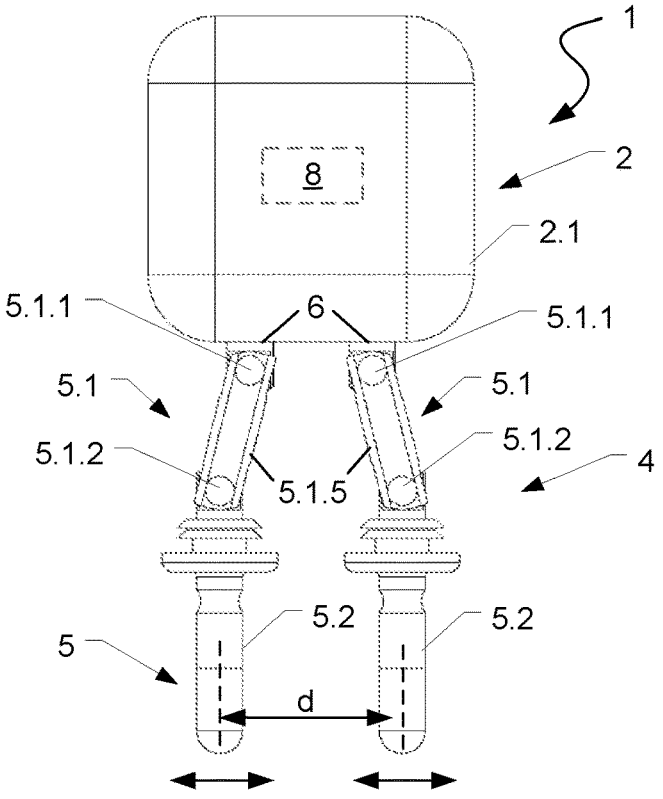
FIG. 1 illustrates an example of a first embodiment of an adapter in a schematic side view.
Figure 2:
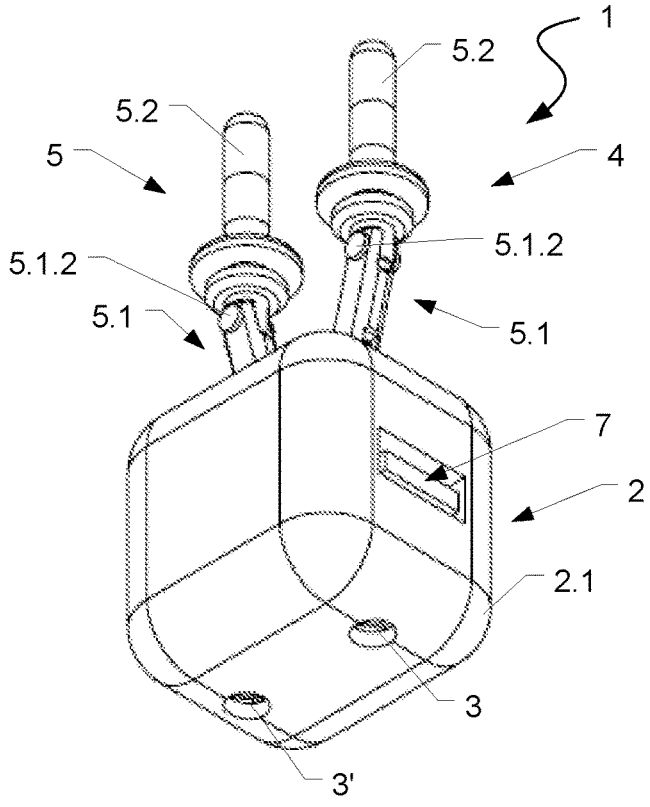
FIG. 2 illustrates an example of the adapter according to FIG. 1 in a perspective drawing.

In FIGS. 1 and 2 a first exemplary embodiment of an adapter 1 according to the invention is shown in different elevations. The adapter 1 comprises a housing section 2 and a contact device 4 which protrudes from this housing section 2. On the housing section 2 at least 2 contact openings 3, 3' are provided, which are arranged in such a way that a plug of an electric appliance, in particular a plug for supplying power, such as a mains plug of types C, E or F (Euro plug "CEE 7/16", contour plugs "CEE 7/17", "CEE 7/5", Schuko plug "CEE 7/4" or "CEE7/7") can be plugged in at the contact openings 3, 3'. In other words the contact openings 3, 3' therefore form an insertion slot for such a mains plug.

The contact device 4 comprises two contact elements 5, which are fixedly anchored and therefore in a stationary manner by means of an anchor section 6, in the housing 2.1 of the housing section 2. Preferably, the contact elements 5 protrude from a side of the housing section 2 opposite to the contact openings 3, 3'.

To be able to adapt the adapter 1 to different types of socket used internationally, at least one contact element 5 has a mechanically deformable first contact element section 5.1, which is designed in such a way that the distance d between the contact elements 5 in the area of the second contact element sections 5.2, which can be plugged into an outlet socket, can be varied. In the above exemplary embodiment, both contact elements 5 are fitted with first contact element sections 5.1 mechanically deformable in this way.

The mechanically deformable first contact element sections 5.1 can be designed in such a way that they can be moved outwards from a starting position, where the second contact element sections 5.2 are arranged parallel to each other at a defined distance d, for example d=19 mm (measured from axis to axis of the second contact element sections 5.2), so that the second contact element sections 5.2 are moved further apart from each other or closer together, so that the distance d between the second contact element sections 5.2 is reduced (indicated by the double arrows in FIG. 1). As a result, the free ends of the contact device 4 to be inserted into the socket can be adjusted to match the respective distance between the contact openings of this socket.

In more detail, the contact device 4 has at least one contact element 5 with a first, mechanically deformable contact element section 5.1 and a second contact element section 5.2, wherein the first contact element section 5.1 is arranged in each case between the anchor section 6 and the second contact element section 5.2. The flexibly deformable first contact element section 5.1 thus forms a connection between the anchor 6 and the second contact element section 5.2. The free ends of the contact elements 5, i.e. the free ends of the second contact element sections 5.2, have an electrically conductive surface to allow an electric contact to be made with the contact elements contained in the socket.

The first contact element section 5.1 forms both an electric and a mechanical coupling between the housing section 2 and the second contact element section 5.2. In the exemplary embodiment according to FIGS. 1 and 2, the first contact element section 5.1 has two hinged joints 5.1.1, 5.1.2, between which a connecting piece is provided, formed by means of a strut 5.1.5 or a pair of struts 5.1.5. The connecting piece may be designed to be not mechanically deformable (i.e. with the normal level of manually exerted forces), in particular not reversibly deformable. A first hinged joint 5.1.1 can in this case be provided in the junction region between the anchor section 6 and the at least one strut 5.1.5. The second hinged joint 5.1.2 is provided in the junction region between the at least one strut 5.1.5 and the second contact element section 5.2. The hinged joints 5.1.1, 5.1.2 ensure that the second contact element sections 5.2 can be aligned parallel to each other in spite of deformation of the first contact element section 5.1. The pivot axes of the hinged joints 5.1.1, 5.1.2 are preferably oriented parallel or substantially parallel to each other.

In the region of the hinged joints 5.1.1, 5.1.2 spring units can be provided, which serve to reset the sections of the contact elements 5 connected by means of the struts into a certain position or angular position. In particular, these spring elements can be integrated into the hinged joints 5.1.1, 5.1.2.

The electric connection of the electric contacts in the region of the contact openings 3, 3' to the free ends of the contact elements 5 can be made, for example, directly via the first contact element section 5.1, i.e. by means of an electrically conductive design of the hinged joints 5.1.1, 5.1.2 and the struts 5.1.5. To achieve this, these must be provided with a suitable electric insulation. Alternatively, in the region of the first contact element sections 5.1, in particular in the interior of the first contact element sections 5.1, an electric conductor, for example an electric cable can be provided, by means of which the electric energy is transmitted to the second contact element section 5.2.

Figure 3:
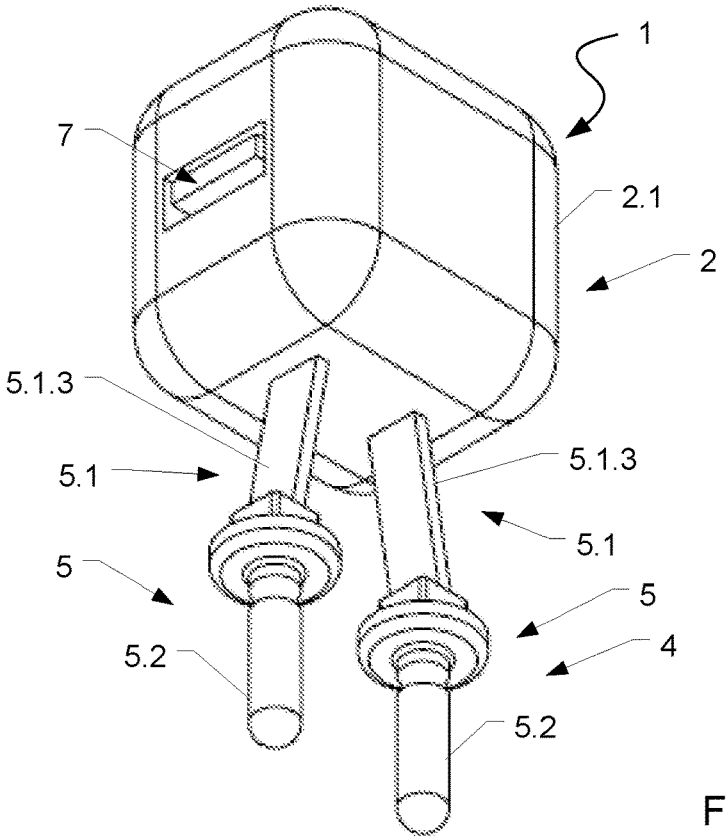
FIG. 3 illustrates an example of a second embodiment of an adapter in a schematic perspective drawing.

FIG. 3 shows a further exemplary embodiment of an adapter 1 according to the invention. In the following text, only the differences in the adapter according to FIG. 3 relative to the above-mentioned adapter according to FIGS. 1 and 2 will be described. In addition, the previous statements also apply to the exemplary embodiment in accordance with FIG. 3.

The main difference between the adapter 1 according to FIG. 3 and the adapter in accordance with FIGS. 1 and 2 is the fact that the first contact element section 5.1 is formed of a flexible or bendable flat material. In general, the contact element section 5.1 can be formed of any flexibly deformable material, in particular a spring element 5.1.3. Such a spring element 5.1.3 can be, for example, a strip-shaped steel spring or else a flat spiral spring. Thanks to the flexible or mechanically deformable design of the contact element section 5.1, the relative distance d between the second contact element sections 5.2 each connected thereto can be changed and the second contact element sections can thus be matched to the respective socket type.

Figure 4:
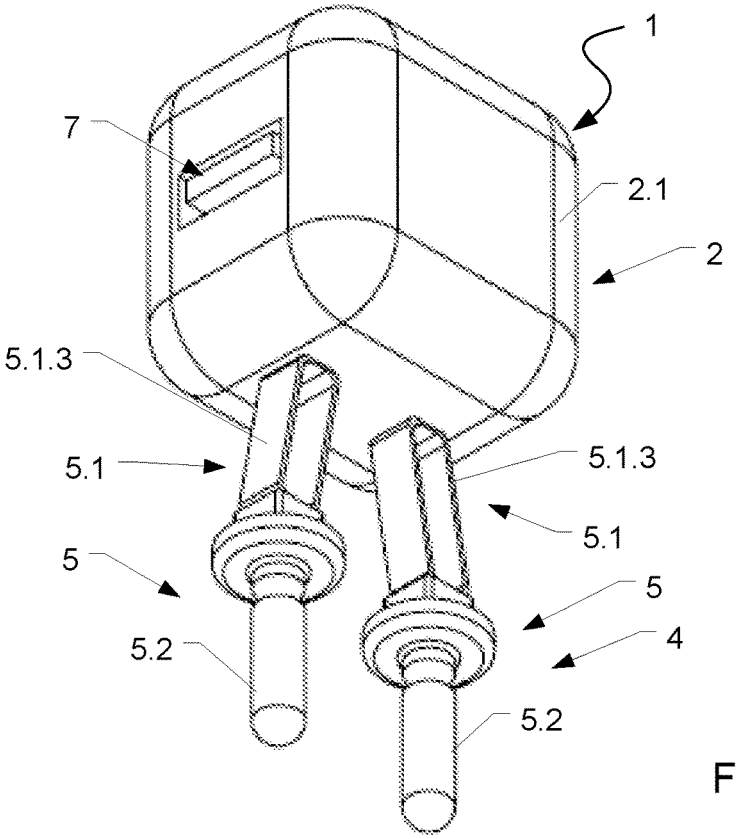
FIG. 4 illustrates an example of a third embodiment of an adapter in a schematic perspective drawing.

FIG. 4 illustrates a third exemplary embodiment of an adapter 1 according to the invention. In the following text, only the differences in the adapter according to FIG. 4 relative to the above-described adapters according to FIGS. 1 to 3 will be described. In addition, the previous statements also apply to the exemplary embodiment in accordance with FIG. 4.

In contrast to the exemplary embodiment in accordance with FIG. 3, the adapter 1 according to FIG. 4 does not merely have one single spring element 5.1.3 per first contact element section 5.1, in particular a single spring element formed by a strip-shaped steel spring, but instead each contact element section 5.1 is formed by a pair of spring steel strips, in particular running parallel to each other. This pair of spring steel strips can be deformed, for example, in a parallelogram-like or substantially parallelogram-like manner, so that second contact element sections 5.2, each joined to the first contact element sections 5.1, can be varied in their distance d relative to each other.

In the exemplary embodiments according to FIGS. 3 and 4, the electric connection of the electric contacts in the region of the contact openings 3, 3' with the free ends of the contact elements 5 can in turn be made directly via the first contact element section 5.1, i.e. via the one spring element 5.1.3 or the at least one spring steel strip. To achieve this, these must be provided with a suitable electric insulation. Alternatively, in the region of the first contact element sections 5.1, in particular in the interior of the first contact element sections 5.1, an electric conductor, for example an electric cable, can be provided by means of which the electric energy is transmitted to the second contact element section 5.2.

Figure 5:
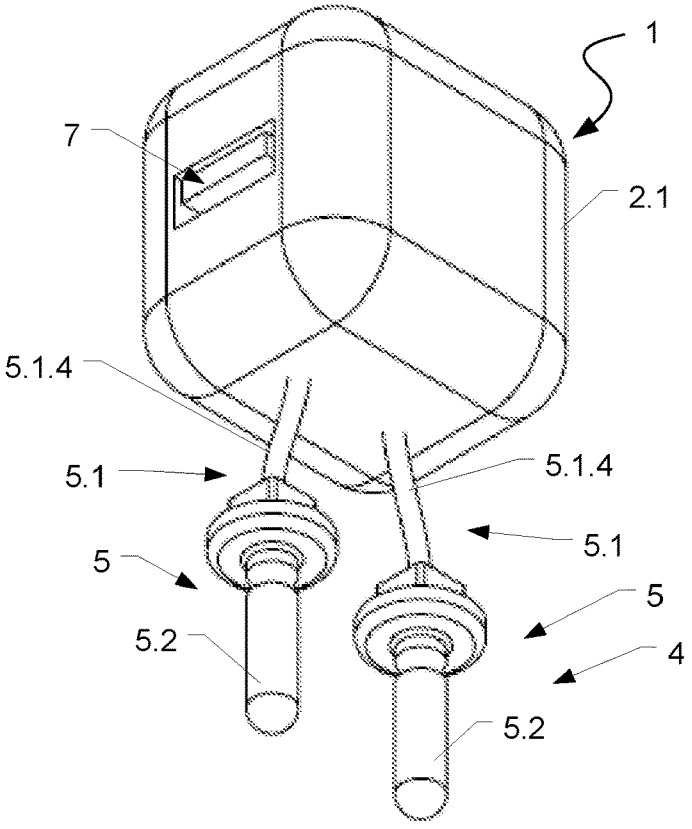
FIG. 5 illustrates an example of a fourth embodiment of an adapter in a schematic perspective drawing.

FIG. 5 shows a fourth exemplary embodiment of an adapter according to the invention 1. In the following text, only the differences in the adapter according to FIG. 5 relative to the above-described adapters according to FIGS. 1 to 4 will be described. In addition, the previous statements also apply to the exemplary embodiment in accordance with FIG. 5.

According to this exemplary embodiment, the first contact element sections 5.1 are each formed by an electric cable 5.1.4. This electric cable 5.1.4 can be designed flexibly or at least semi-flexibly, i.e. consisting of a material that can be mechanically deformed within certain limits. This electric cable 5.1.4, in addition to the mechanical connection of the second contact element sections 5.2 to the housing section 2, can also provide the electric coupling of the electric contacts formed at the free ends of the second contact element sections 5.2 to the electric contacts in the region of the contact openings 3, 3'.

Figure 6:
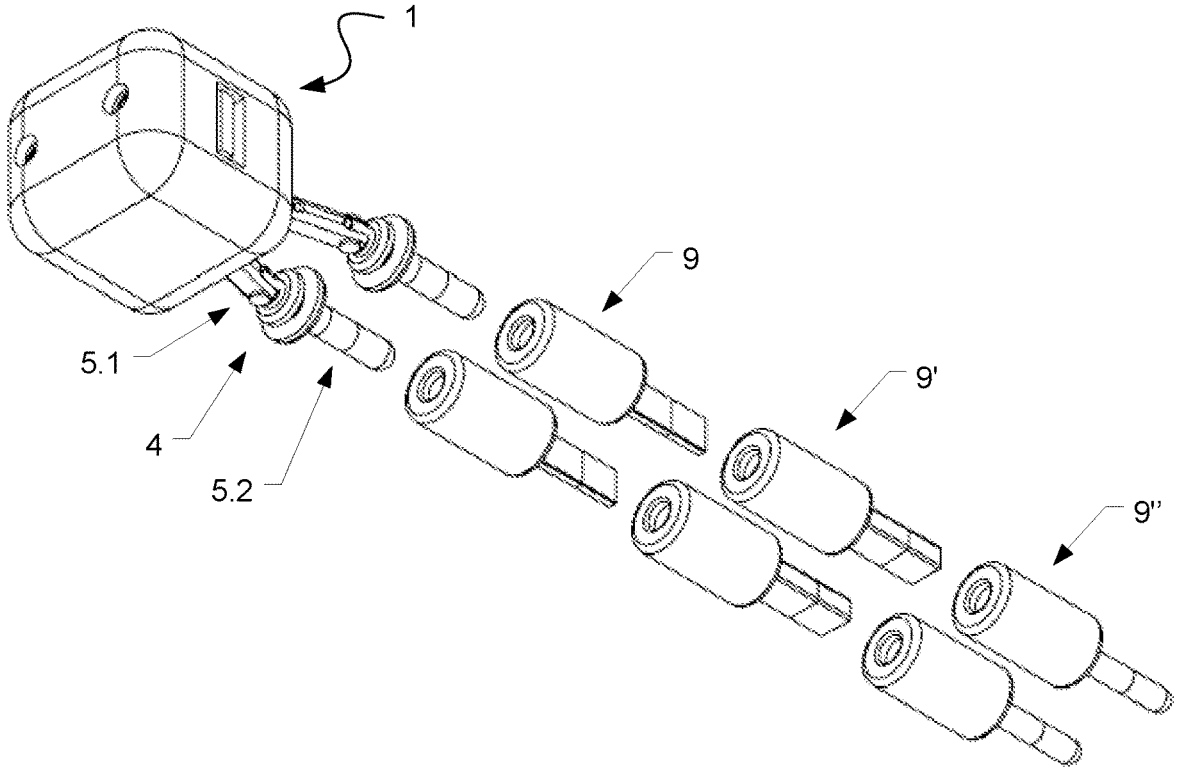
FIG. 6 illustrates an example of an adapter with a plurality of pairs of contact element adapters in a perspective exploded view.

As shown in FIG. 6, the free ends of the contact elements 5, in particular the free ends of the second contact element sections 5.2, can be designed in a jack-plug style, so that contact element adapters 9, 9', 9" can be plugged onto these free ends. The contact element adapters 9, 9', 9" can have a contact section which is matched to the respective socket type in its shape and size. At the end opposite the contact section, an opening can be provided into which the free end of the second contact element section 5.2 of the adapter 1 can be inserted. In this opening, means can be provided for locking the contact element adapter 9, 9', 9" to the second contact element section 5.2. This allows the contact element adapters 9, 9', 9" to be held on the second contact element sections 5.2 in a form-fitting or positive-locking manner.

As previously described, the first contact element sections 5.1 can have an electric insulation. This insulation can be formed, for example, by a thermoplastic elastomer. The insulation can be formed as a single-layer or multi-layer structure from identical or different materials. The insulation can be produced, in particular, by encapsulation of the first contact element section 5.1.

Regardless of the embodiment of the contact elements 5, a USB socket 7 can be provided on the housing section 2. In particular, the USB socket 7 can be of connector type C and, for example, meet the USB 3.0 or 3.1 standard. The USB socket 7 may be used, in particular, to provide a charging function. The housing section 2 can contain a transformer, for example, via which the mains voltage (100V to 230V AC) is transformed into a DC voltage. This DC voltage is provided at the USB socket 7, for example to charge devices there, such as mobile phones, tablets, E-readers or cameras.

To protect the adapter 1 against excessive electric currents that may flow through the USB socket 7, for example during the charging process, a fuse can be provided, in particular a self-resetting fuse. Such self-resetting fuses are formed, for example, by means of a semiconductor which has a non-linear resistance profile. At high electric currents, such as in a short circuit, this PTC thermistor heats up and consequently becomes highly resistive. This approximates to a quasi-deactivation of the charging function. After the PTC thermistor has cooled down, this becomes low-resistance again, which approximates to turning on the charging function. This advantageously eliminates a replacement of the fuse after the occurrence of an excessive electric current.

In addition, the adapter 1, as indicated schematically for example in FIG. 1, can have a storage unit 8, in particular a Flash memory unit. This storage unit 8 can be connected in particular to the USB socket 7. The adapter 1 can be designed, for example, to implement a backup function, in particular a backup copying process. In this case, for example, data can be transferred from a device which is coupled to the adapter 1 via the USB socket 7 to the storage unit 8 and stored there. The adapter 1 may, in particular, be designed in such a way that a backup copy to the storage unit 8 of the adapter 1 is carried out at the same time, for example during the charging of the device. In doing so, in particular an automatic encryption of the data may be carried out (for example, on-the-fly encryption).

Furthermore, the adapter 1 can be designed to be independently network-addressable. For example, the adapter 1 can be connected to a network via a wired (network cable interface or via the mains network) or a wireless (e.g. WLAN) network interface. This allows data to be transferred from the adapter 1 to the network or from the network to the adapter 1, in particular from the storage unit 8 of the adapter 1 to the network or from the network to the storage unit 8 of the adapter 1. It is therefore possible for the data stored on the adapter 1 to be made available in the network. Furthermore, via the network interface it is possible to monitor the functionality of the adapter 1 or to switch the latter on or off, or start other monitoring and control processes.

Figure 7:
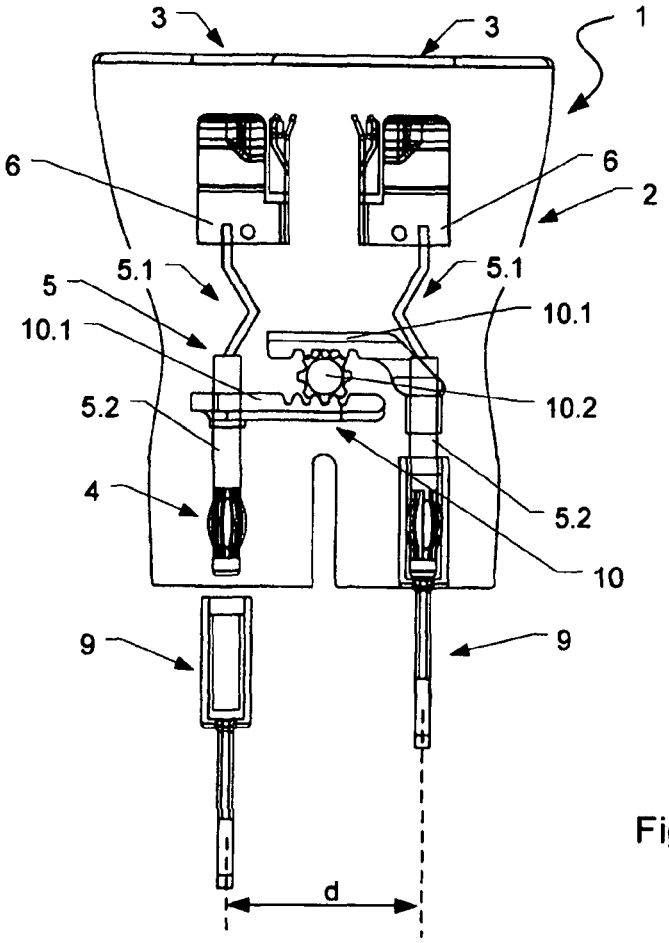
FIG. 7 illustrates an example of a fifth embodiment of an adapter in a schematic perspective drawing.

FIG. 7 shows a further embodiment of the adapter 1, in which the distance d of the second contact element sections 5.2 is adjustable using an adjusting mechanism 10. In contrast to the preceding exemplary embodiments the first contact element sections 5.1 are located within the housing 2. This housing 2 also accommodates the adjusting mechanism 10.

The adjustment mechanism 10 comprises a gear mechanism in the exemplary embodiment shown. Thus, for example, to each contact element section 5.1 a toothed rod 10.1 is fixed, which in at least some sections protrudes towards a centre axis of the adapter 1. In other words, the toothed rods 10.1 protrude into the interior of the housing 2. The toothed rods 10.1 each have a toothing arrangement. The toothing arrangements of the two toothed rods 10.1 are spaced apart from each other. Between the toothed rods 10.1 a gear wheel 10.2 is arranged, which on each of the diametrically opposite sides is operatively connected to the toothed rods 10.1, in particular meshing with the toothing system of the toothed rods 10.1. A rotation of the gear wheel 10.2 can cause a change in the distance d between the second contact element sections 5.2.

As an alternative to the gear mechanism described above, other mechanisms can also be used, such as a mechanism operated by a lever or a pressure unit or an eccentric mechanism, by means of which a linear displacement of the contact elements 5 is possible.

Guiding means are preferably provided in the housing 2, which provide a bearing, in particular a sliding bearing of the contact elements 5 in the housing.

The invention has been described above based on exemplary embodiments. It is understood that numerous changes and modifications are possible without thereby departing from the inventive idea underlying the invention.

LIST OF REFERENCE NUMERALS

1 adapter
2 housing section
2.1 housing
3,3' contact openings
4 contact device
5 contact element
5.1 first contact element section
5.1.1 hinged joint
5.1.2 hinged joint
5.1.3 spring element
5.1.4 electric cable
5.1.5 strut
5.2 second contact element section
6 anchor section
7 USB socket
8 storage unit
9, 9', 9" contact element adapter
10 adjusting mechanism
10.1 toothed rod
10.2 gear wheel
d distance

The invention claimed is:

1. An electric adapter for electrically connecting electric appliances to a socket, comprising:

a housing section with at least two contact openings for connection to a plug of an electric appliance; and a contact device with a pair of contact elements for electrically connecting the electric adapter to a socket, each of the pair of contact elements providing a flow of electrical current from the socket to the appliance, wherein the contact elements are fixedly coupled to the housing section by an anchor section; and wherein at least one contact element comprises, a mechanically deformable first contact element section, and a second contact element section movably coupled to the first contact element section, so that a distance between two second contact element sections that can be inserted into the socket can be varied, wherein the first contact element sections of two contact elements forming the pair of contact elements are each designed to be mechanically deformable.

2. The electric adapter according to claim 1, wherein the mechanically deformable first contact element section is arranged between the anchor section and the second contact element section.

3. The electric adapter according to claim 1, wherein the mechanically deformable first contact element section comprises at least two hinged joints.

4. The electric adapter according to claim 1, wherein the mechanically deformable first contact element section comprises a spring element which is adapted to be deformed by bending.

5. The electric adapter according to claim 4, wherein the spring element comprises at least one spring steel strip or at least one flat spiral spring.

6. The electric adapter according to claim 1, wherein the mechanically deformable first contact element section comprises at least one electric conductor.

7. The electric adapter according to claim 1, wherein the mechanically deformable first contact element section comprises an electric insulation.

8. The electric adapter according to claim 7, wherein the insulation is made from a thermoelastic elastomer.

9. The electric adapter according to claim 7, wherein the insulation is formed by encapsulation of at least one part of the contact element.

10. The electric adapter according to claim 1, wherein the mechanically deformable first contact element section is designed, after a distance change of the second contact element sections by action of external forces, to deform back into a starting position automatically, when the external forces decrease or are no longer applied.

11. The electric adapter according to claim 1, wherein the mechanically deformable first contact element section is received in the housing section or arranged outside of the housing section.

12. The electric adapter according to claim 1, further comprising an adjusting mechanism adapted to adjust the distance between the second contact element sections.

13. The electric adapter according to claim 12, wherein the adjusting mechanism is a lever mechanism, a gear mechanism, or a mechanism comprising at least one eccentric mechanism.

14. The electric adapter according to claim 1, wherein the distance between the second contact element sections can be varied in a range between 10 mm and 30 mm.

15. The electric adapter according to claim 1, further comprising a USB socket provided on the housing section.

16. The electric adapter according to claim 15, wherein the USB socket is configured to be supplied with electric energy via a self-resetting electric fuse.

17. The electric adapter according to claim 16, further comprising a storage unit in the housing section adapted for storing data.

18. The electric adapter according to claim 17, wherein the storage unit is configured to be accessed via the USB socket.

19. The electric adapter according to claim 17, wherein the adapter comprises a network interface, and the storage unit is configured to be accessed via a network connection.

20. The electric adapter according to claim 17, wherein the storage unit is adapted to encrypt the data stored therein.

* * * * *